US006169272B1

(12) United States Patent
Racine et al.

(10) Patent No.: US 6,169,272 B1
(45) Date of Patent: Jan. 2, 2001

(54) NOZZLE HEATER FOR DIE CASTING MACHINE

(75) Inventors: Donald C. Racine, Grand Blanc; John Joseph Zsigo, Lennon, both of MI (US)

(73) Assignee: Delphi Technologies, Inc., Troy, MI (US)

( * ) Notice: Under 35 U.S.C. 154(b), the term of this patent shall be extended for 0 days.

(21) Appl. No.: 09/499,324

(22) Filed: Feb. 7, 2000

(51) Int. Cl.[7] ..... H05B 3/06; H05B 3/58; B22D 17/02; B67D 5/63

(52) U.S. Cl. ..... 219/424; 219/426; 219/530; 222/146.5; 164/311

(58) Field of Search ..... 219/424, 426, 219/526, 530, 535, 536, 540; 164/311; 239/135; 392/473; 222/146.5; 425/549

(56) References Cited

U.S. PATENT DOCUMENTS 3,811,601 * 5/1974 Reighard et al. ..... 222/146.5
3,827,604 * 8/1974 Hamilton et al. ..... 222/146.5
4,635,851 1/1987 Zecman ..... 239/133
5,315,686 * 5/1994 Caugherty et al. ..... 222/146.5
5,720,417 * 2/1998 Wurth et al. ..... 222/146.5
5,791,531 * 8/1998 Hassler, Jr. ..... 222/504

* cited by examiner

*Primary Examiner*—Joseph Pelham
(74) *Attorney, Agent, or Firm*—Jimmy L. Funke

(57) ABSTRACT

A heater for the injection nozzle of a die casting machine includes a mounting block which is clamped to the nozzle and has a cavity for receiving an off-the-shelf electric cartridge heater. The mounting block includes a casing formed from a high strength material such as steel and a quantity of a second material having a high thermal conductivity such as copper encased in the casing. A hole sized to receive the injection nozzle is formed through the block and passes through the second material so that the second material forms a portion of the inner surface of the hole. The heater cavity extends into the block along an axis generally perpendicular to the hole such that the second material forms a portion of the inner surface of the hole. The quantity of second material connects the two holes and forms a heat conductive path between the heater receiving hole and the nozzle receiving hole.

17 Claims, 2 Drawing Sheets

NOZZLE HEATER FOR DIE CASTING MACHINE

FIELD OF THE INVENTION

This invention relates to die casting machines and more particularly to an electric heater for maintaining the nozzle of such a die casting machine at a desired temperature during the casting operation.

BACKGROUND OF THE INVENTION

In a die casting operation, a quantity of molten metal is forced under pressure from a reservoir through a nozzle into a mold or die. The molten metal must be maintained at a minimum temperature so that it is sufficiently fluid to flow freely and fully into the die so as to prevent voids or porosity in the finished part. It is often desirable to maintain the pressure on the molten metal in the mold for a length of time sufficient for it to solidify. During this dwell time, the injection nozzle, if not provided with some heat source, may cool to the point where the molten metal inside the nozzle solidifies and plugs the nozzle.

It is known to utilize gas-fired or electric heaters to maintain the injection nozzle at a sufficient temperature to prevent clogging of the nozzle by solidified material. Gas flame heaters tend to waste a great deal of energy and are not amenable to precise temperature control. Prior art electrically heated nozzles have included complicated and expensive structures utilizing electrically conductive wires or thermally conductive bands integrated into the nozzle to achieve uniform heating. See, for example, U.S. Pat. No. 4,635,851 and U.S. Pat. No. 4,638,849.

Many die casting machines are in use which would benefit from the addition of a heated nozzle. Due to the configuration of some of these machines, however, it would be impossible or prohibitively expensive to retrofit them with heated nozzles according to the prior art designs.

SUMMARY OF THE INVENTION

According to the present invention, an off-the-shelf electric cartridge heater is mounted to a conventional unheated nozzle of a die casting machine. A mounting block is provided which receives the cartridge heater and is clamped or otherwise secured to the nozzle such that heat generated by the cartridge heater is transferred to the nozzle. According to a feature of the invention, the mounting block comprises a casing formed from a high strength material such as steel and a quantity of a second material having a high thermal conductivity such as copper encased in the casing. A first hole sized to receive the injection nozzle is formed through the block and passes through the second material so that the second material forms a portion of the inner surface of the hole. A second hole sized to receive the cartridge heater extends into the block along an axis generally perpendicular to the first hole such that the second material forms a portion of the inner surface of the hole. The quantity of second material connects the two holes and forms a heat conductive path between the heater receiving hole and the nozzle receiving hole.

According to a first embodiment of the invention, the second material is disposed in a slot extending into the block from a surface thereof and running generally axially with respect to the heater receiving hole. This embodiment of the invention is relatively simple and inexpensive to manufacture, and the block may be constructed in a wide variety of sizes to meet the dimensional constraints involved in mounting it to a particular die casting machine.

According to a second embodiment of the invention, the mounting block casing has first and second slots extending along opposite sides of the heater receiving hole, both of which contain the second material and wrap around portions of the circumference of the nozzle receiving hole. This provides for increased heat transfer between the heater and the nozzle as compared with the first embodiment.

According to a third embodiment of the invention, the mounting block casing is a hollow cylinder containing the second material and the heater receiving hole extends into the second material along the axis of the cylinder so that the second material forms the entire inner surface of the hole.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENTS

Figure 1:
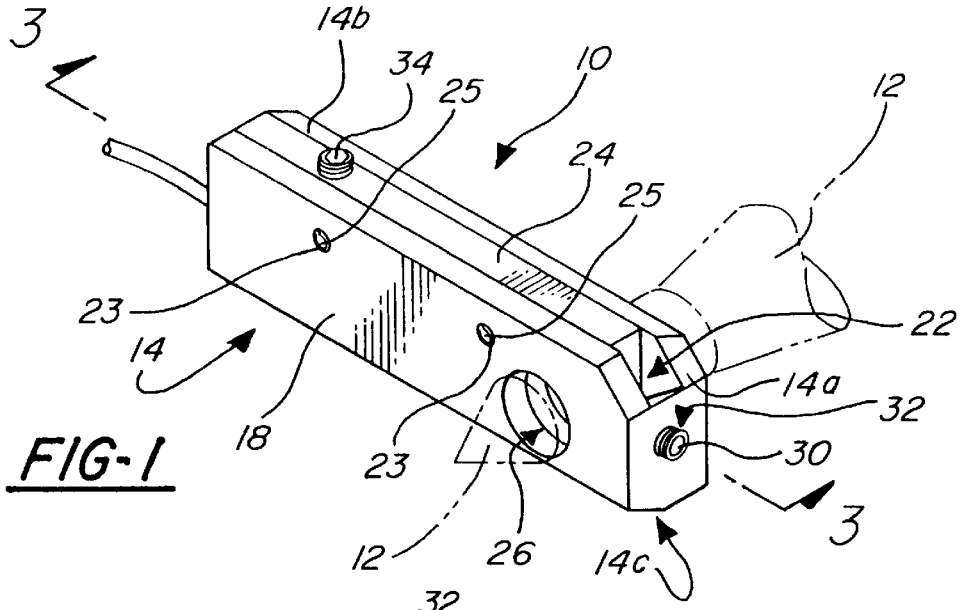
FIG. 1 is a perspective view of the nozzle heater according to a first embodiment of the invention mounted to a die cast machine injection nozzle.

FIG. 1 depicts a nozzle heater 10 according to a first embodiment of the present invention operatively attached to an injection nozzle 12 of a die casting machine. The nozzle heater 10 comprises a mounting block 14 and an electric cartridge heater 16 retained therein. The injection nozzle 12 depicted is intended to represent the nozzle such as is used on any conventional die casting machine, and may vary from the configuration shown without effecting the scope of the present invention.

Figure 3:
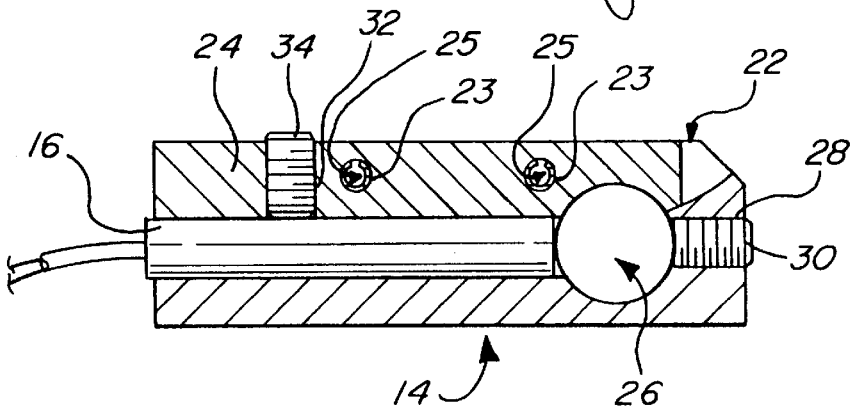
FIG. 3 is a cross section view taken along line 3–3 of FIG. 2.
Figure 2:
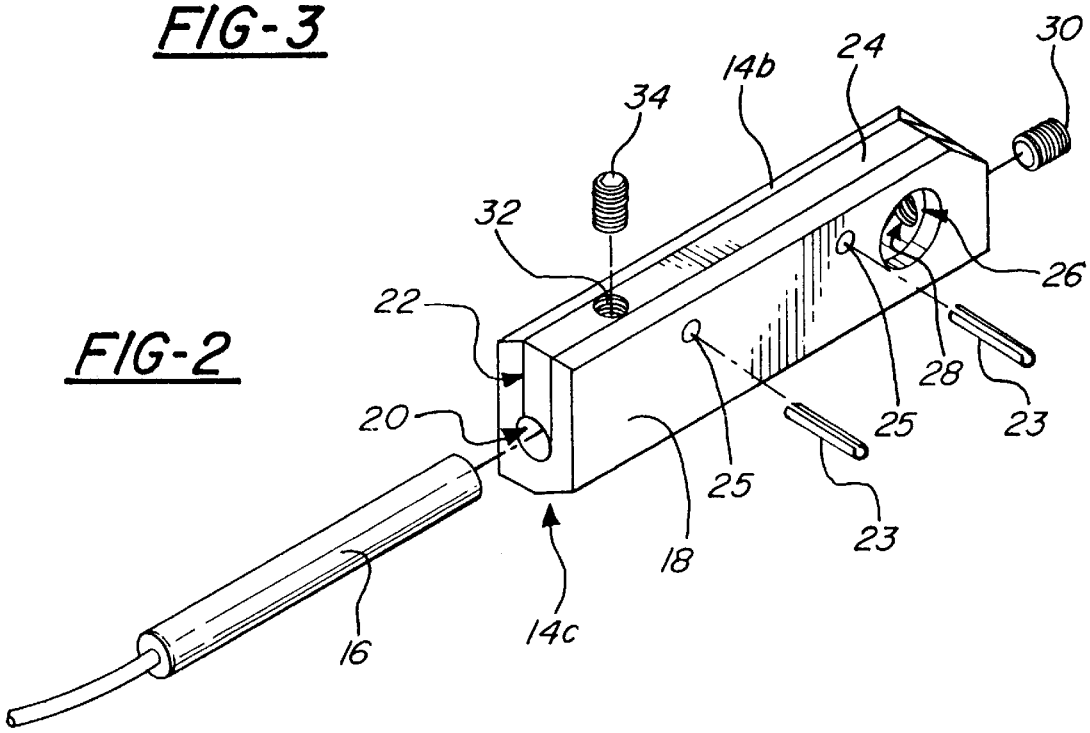
FIG. 2 is an exploded perspective view of the nozzle heater of FIG. 1.

As best seen in FIGS. 2 and 3, the mounting block 14 comprises a generally rectangular casing 18 formed of a high strength material such as steel. A cylindrical cavity 20 extends into the casing 18 from one end thereof and is sized to receive the cartridge heater 16. A slot 22 extends downwardly into the casing 18 from its upper surface, the lower end of the slot 22 intersecting the heater cavity 20. The slot 22 runs along the length of the casing 18 and is substantially filled with a material 24 having a high thermal conductivity, such as copper.

The heat conductive material 24 may be press fit into the slot 22 and positively secured in place by one or more roll pins 23 inserted through holes 25 which pass transversely through the mounting block 14.

A hole 26 is formed completely through the mounting block 14 adjacent the second end thereof and is sized to fit around the nozzle 12 as shown in FIG. 1. A smaller threaded hole 28 extends into the mounting block 14 from the second end thereof and receives a set screw 30 which is used to secure the heater 10 to the nozzle. Due to the high temperature of the mounting block during operation of the heater 10, the screw 30 may tend to seize in the mounting block. It has been found that this problem may be minimized by forming the set screw 30 from stainless steel and coating the threads with an anti-seize compound.

A second threaded hole 32 extends downwardly from the upper surface of the mounting block 14 to communicate with the heater cavity 20. Hole 32 receives a set screw 34 to retain the cartridge heater 16 securely in the cavity 20. Hole 32 may be of a diameter equal to or less than the width of slot 22 so that hole 32 passes through only the heat conductive material 24. Alternatively, hole 32 may be slightly larger so that its outer edges extend into the high strength material of the casing 18.

As best seen in FIG. 3, the strip of heat conductive material 24 disposed in the slot 22 extends along the upper side of the heater cavity 20 to form a portion of the inner surface thereof so as to contact the outer surface of the cartridge heater 16 when it is in the cavity 20. The conductive material 24 also extends around the upper half of the circumference of the nozzle receiving hole 26 so that the heat conductive material forms a portion of the inner surface of the nozzle hole, and thus contacts the outer surface of the nozzle 12 when the mounting block 14 is secured to the nozzle 12 as shown in FIG. 1. Accordingly, the heat conductive material 24 forms a path connecting the cartridge heater 16 with the nozzle 12, thereby conducting a large portion of the heat generated by the cartridge heater 16 to the nozzle 12. It has been found that, in order to achieve a sufficient amount of heat transfer from the cartridge heater 16 to the nozzle 12, it is important that the heat conductive material 24 contact the circumferential surface of the heater, rather than just the end of heater adjacent the nozzle receiving hole 26. The cartridge heater 16 is preferably coated with heat sink grease prior to insertion into the heater cavity 20 to ensure efficient transfer of heat to the second material 24.

It has been found that a commercially available cartridge heater operating at 120 volts and 80 watts is sufficient to maintain a nozzle such as is used on a Fisher™ die casting machine at a temperature of approximately 500° F., this temperature being adequate for many die casting operations utilizing lead. If a higher nozzle temperature is desirable for a particular application, an appropriate heater may be utilized.

Depending upon the particular geometry of the die casting apparatus on which the invention nozzle heater is to be installed, limited clearance between the nozzle and the mold die or other apparatus associated with the molding process may necessitate modification of the overall rectangular shape of the mounting block 14. For example, the mounting block 14 is shown with a bevel 14*a* formed across one corner of the mounting block adjacent the nozzle receiving hole 26, and chamfers 14*b*, 14*c* formed along opposite edges along the length of the block.

Figure 4:
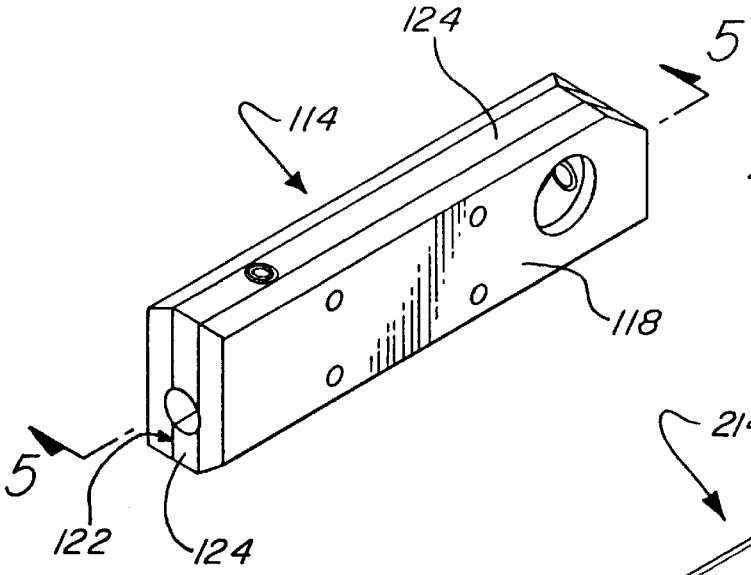
FIG. 4 is a perspective view of a second embodiment of a nozzle heater block according to the present invention.
Figure 5:
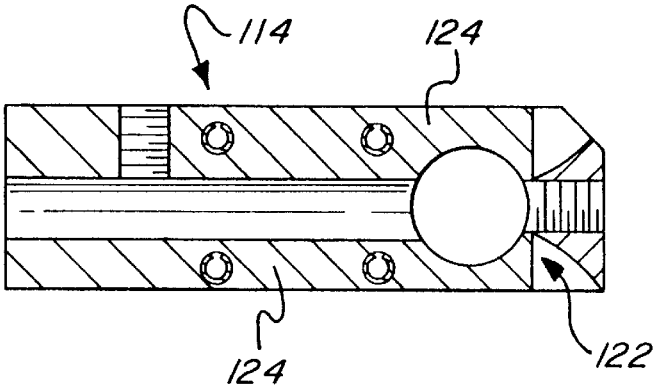
FIG. 5 is a cross section view taken along line 5-5 of FIG. 4.

In a second embodiment of the invention shown in FIGS. 4 and 5, a mounting block 114 is generally similar to that of the first embodiment except for the addition of a second slot 122 in the lower surface of the casing 118 which is filled with a thermally conductive material 124 such as copper. As is evident from FIG. 5, this embodiment provides for twice the amount of surface area contact between the thermally conductive material 124 and both the cartridge heater 16 and the nozzle 12, thus increasing the efficiency of heat transfer.

Figure 6:
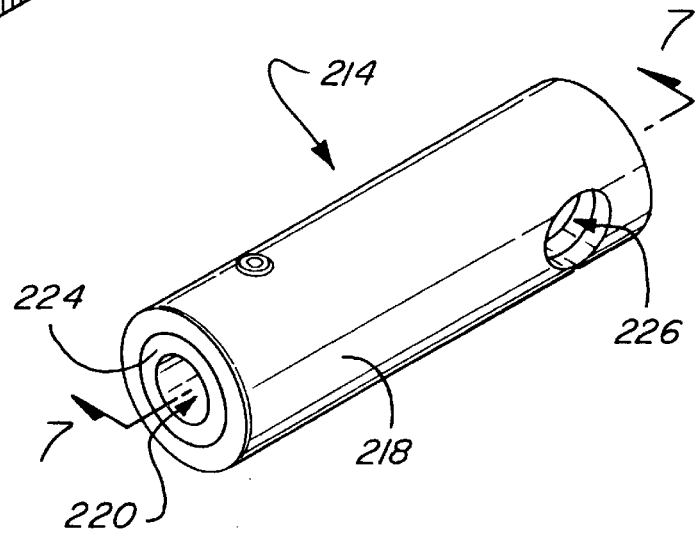
FIG. 6 is a perspective view of a third embodiment of the invention.
Figure 7:
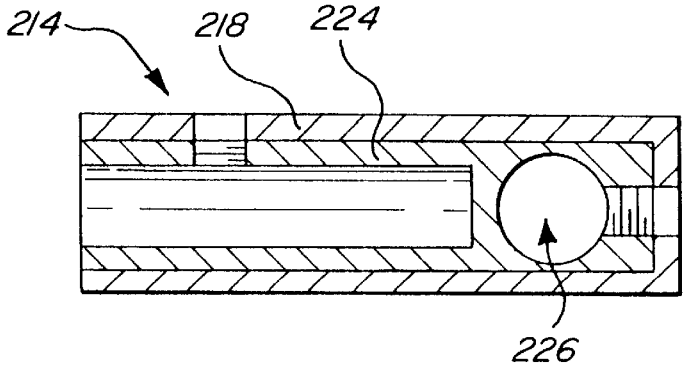
FIG. 7 is a cross section view taken along line 7-7 of FIG. 6.

A third embodiment of the invention is shown in FIGS. 6 and 7 and comprises a tubular steel casing 218 surrounding a core of thermally conductive material 224. A heater cavity 220 extends into the core 224 coaxially with the mounting block 214, and a nozzle receiving hole 226 extends transversely through the mounting block 214 adjacent the blind end of the heater cavity 220. In this embodiment of the invention, the areas of surface contact between the thermally conductive material 224 and both the cartridge heater 16 and the nozzle 12 are further maximized in order to achieve more efficient heat transfer.

While the invention has been described in connection with what is presently considered to be the most practical and preferred embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A mounting block for attaching a cartridge heater to an injection nozzle of a die casting machine, the mounting block comprising:

a casing formed from a first, high-strength material;

a quantity of a second material at least partially encased within the casing and extending along a first axis of the block, the second material having a thermal conductivity greater than that of the first material;

a nozzle receiving hole formed through the block along a second axis of the block generally perpendicular to the first axis and passing through the quantity of second material such that the second material forms at least a portion of an inner surface of the nozzle receiving hole; and a heater cavity extending into the block parallel to the first axis adjacent the quantity of second material and having an end adjacent the nozzle receiving hole, the second material forming at least a portion of an inner surface of the heater cavity, whereby the second material forms a heat conductive path between the heater cavity and the nozzle receiving hole.

2. The mounting block according to claim 1 wherein the quantity of second material is disposed in a slot extending into the block from a surface of the block.

3. The mounting block according to claim 2 wherein the slot extends generally radially with respect to the heater cavity.

4. The mounting block according to claim 1 wherein the quantity of second material is disposed within a hollow interior of the casing.

5. The mounting block according to claim 4 wherein the casing is a hollow cylinder containing the second material and the heater cavity extends into the second material along the axis of the cylinder so that the second material forms the entire inner surface of the heater cavity.

6. The mounting block according to claim 1 wherein the second material is disposed between the end of the heater cavity and the nozzle receiving hole.

7. The mounting block according to claim 1 further comprising a second quantity of the second material at least partially encased in the casing and extending along the axis of the heater cavity to form a second portion of the inner surface of the heater cavity and extending around the nozzle receiving hole to form a second portion of the inner surface of the nozzle receiving hole.

8. The mounting block according to claim 1 wherein the second material is copper.

9. A nozzle heater for mounting to an injection nozzle of a die casting machine, the nozzle heater comprising:

a mounting block comprising a casing formed from a first, high-strength material and a quantity of a second material at least partially encased within the casing and extending along a first axis of the block, the second material having a thermal conductivity greater than that of the first material;

a nozzle receiving hole formed through the block along a second axis of the block generally perpendicular to the first axis and passing through the quantity of second material such that the second material forms at least a portion of an inner surface of the nozzle receiving hole; and a heater cavity extending into the block parallel to the first axis adjacent the quantity of second material and having an end adjacent the nozzle receiving hole, the second material forming at least a portion of an inner surface of the heater cavity, whereby the second material forms a heat conductive path between the heater cavity and the nozzle receiving hole; and a cartridge heater positioned within the heater cavity in contact with the second material.

10. The nozzle heater according to claim 9 wherein the quantity of second material is disposed in a slot extending into the block from a surface of the block.

11. The nozzle heater according to claim 10 wherein the slot extends generally radially with respect to the heater cavity.

12. The nozzle heater according to claim 9 wherein the quantity of second material is disposed within a hollow interior of the casing.

13. The nozzle heater according to claim 12 wherein the casing is a hollow cylinder substantially surrounding the second material and the heater cavity is completely surrounded by the second material.

14. The nozzle heater according to claim 9 wherein the second material is disposed between the end of the heater cavity and the nozzle receiving hole.

15. The nozzle heater according to claim 9 further comprising a second quantity of the second material at least partially encased in the casing and extending along the axis of the heater cavity to form a second portion of the inner surface of the heater cavity and extending around the nozzle receiving hole to form a second portion of the inner surface of the nozzle receiving hole.

16. The nozzle heater according to claim 9 wherein the second material is copper.

17. A nozzle heater for mounting to an injection nozzle of a die casting machine, the nozzle heater comprising:

a mounting block comprising a steel casing having a slot extending inwardly from an outer surface of the casing and running along a first axis of the casing, and a strip of copper disposed in the slot;

a nozzle receiving hole formed through the mounting block along a second axis generally transverse to the first axis and passing through the copper strip such that the copper strip forms a portion of an inner surface of the nozzle receiving hole;

a heater cavity extending into the mounting block parallel to the first axis such that the copper strip forms a portion of an inner surface of the heater cavity, the heater cavity having an end adjacent the nozzle receiving hole; and a cartridge heater positioned within the heater cavity in contact with the copper strip.

* * * * *